United States Patent [19]

Zorini

[11] Patent Number: 4,984,437

[45] Date of Patent: Jan. 15, 1991

[54] DRIVING MECHANISM FOR THE CONTROL OF THE NEEDLE-BAR AND TUBE-BARS IN FAST KNITTING MACHINES

[76] Inventor: Luigi O. Zorini, Via dei Mille 71, 27024 Cilavegna PV, Italy

[21] Appl. No.: 407,273

[22] Filed: Sep. 14, 1989

[30] Foreign Application Priority Data

Apr. 21, 1989 [IT] Italy ..... 20241 A/89

[51] Int. Cl.[5] ..... D04B 27/08

[52] U.S. Cl. ..... 66/208

[58] Field of Search ..... 66/204, 208; 139/188, 139/190

[56] References Cited

U.S. PATENT DOCUMENTS

| | | | |
|---|---|---|---|
| 2,562,034 | 7/1951 | Hannay | 66/204 |
| 3,279,219 | 1/1964 | Kohl | 66/208 |
| 3,587,254 | 6/1971 | Kohl | 66/208 |
| 3,802,226 | 4/1974 | Kohl | 66/208 |
| 4,018,065 | 4/1977 | Liebrandt et al. | 66/208 |

*Primary Examiner*—Werner H. Schroeder
*Assistant Examiner*—John J. Calvers
*Attorney, Agent, or Firm*—Laff, Whitesel, Conte & Saret

[57] ABSTRACT

A driving mechanism (1) comprising first and second drive shafts (10, 22) respectively causing the movement, through first and second eccentrics (17, 24) of a needle bar (3) and one or several tube-bars (5). Also mounted on the drive shafts (10, 22) are auxiliary eccentrics (18, 26) which control the movements of respective counterweights (21, 28) in phase opposition relative to the oscillatory movements transmitted to the needle-bar (3) and tube-bars (5), in order to counterbalance the forces of inertia resulting from the reciprocating movements imparted to the bars (3, 5) themselves.

7 Claims, 1 Drawing Sheet

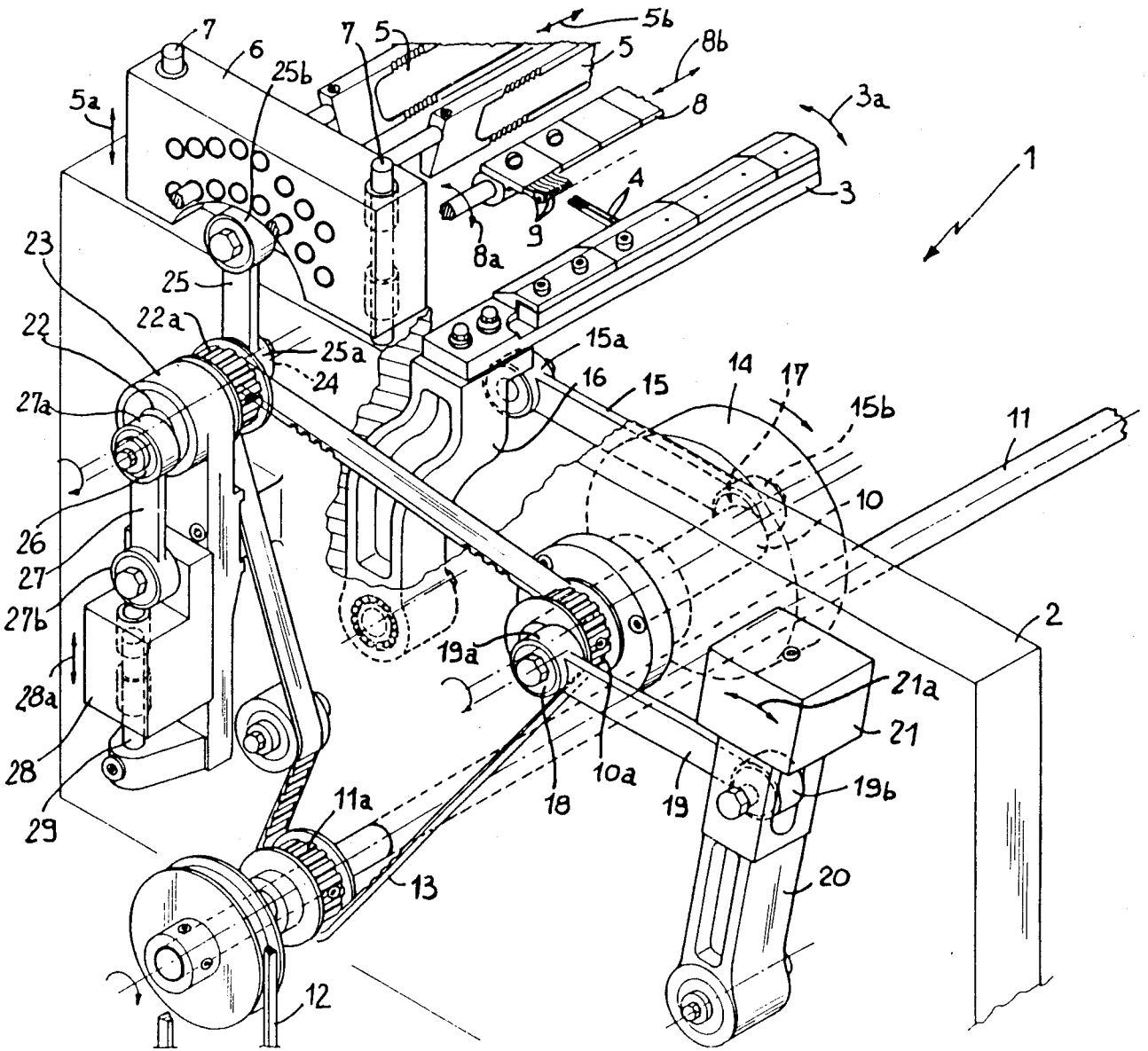
1
2
3
3a
4
5
5a
5b
6
7
8
8a
8b
9
10
10a
11
11a
12
13
14
15
15a
15b
16
17
18
19
19a
19b
20
21
21a
22
22a
23
24
25
25a
25b
26
27
27a
27b
28
28a
29

DRIVING MECHANISM FOR THE CONTROL OF THE NEEDLE-BAR AND TUBE-BARS IN FAST KNITTING MACHINES

FIELD AND BACKGROUND OF THE INVENTION

The present invention relates to a driving mechanism for the control of the needle-bar and tube-bars in fast knitting machines, of the type comprising: a support bed provided with at least two side posts; at least one drive shaft rotatably engaged through each of said posts; a pair of swinging arms each rotatably connected to one of said posts and fixedly engaging a needle-bar; a pair of first driving connecting rods each of them exhibiting one end pivoted to one of said swinging arms and the opposite end operatively engaged on one eccentric carried by said first drive shaft; a second drive shaft rotatably engaged to each of said posts; a pair of oscillating supports each of them being slidably engaged in a substantially vertical direction with one of said posts and engaging at least a tube-bar at one end thereof; a pair of second driving connecting rods each exhibiting one end connected to one of said oscillating supports and the opposite end operatively engaged with a second eccentric carried by the second drive shaft; said first and second drive shafts being driven simultaneously in rotation in order to respectively cause the operation of the needle-bar according to a substantially horizontal oscillatory movement and the operation of the tube-bar according to a substantially vertical oscillatory movement.

It is known that in fast knitting machines the needle-bar is fastened by its opposite ends to two swinging arms which are pivoted, according to a horizontal axis, to two posts forming part of the machine bed. Acting upon each of said swinging arms is one driving connecting rod operatively engaging with a respective eccentric mounted to a main shaft the opposite ends of which are rotatably engaged through said posts. The main shaft is driven in rotation by a motor in order to impart an oscillatory movement in a substantially horizontal direction to the needle-bar, through the eccentrics, first driving connecting bars and swinging arms.

The rotation of the main shaft is transmitted, by a pair of toothed belts or the like acting on the opposite ends of the main shaft, to a pair of second shafts each of which is rotatably engaged to one of the posts. Associated with each of said second shafts is a second eccentric operatively engaging a second driving connecting rod. The second driving connecting rods give rise to the movement of two oscillating supports each of which is slidably engaged with two guide rods upstanding from the corresponding post.

Engaged with the oscillating supports by its opposite ends is at least a tube-bar carrying a number of threading tubes arranged such as to cooperate with the needles carried by the needle-bar and with other instrumetalities of the knitting machine in order to carry out the knitting of the workpiece.

Due to the rotation transmitted to the second drive shafts, the second connecting rods actuates the supports, and hence the tube-bar or bars transmitting a substantially vertical oscillatory movement to the same.

Also operating on the tube-bars is a second driving mechanism which, actuated by a so-called "glider chain" transmits an oscillatory movement in a horizontal direction to the bars themselves, which movement is vectorially combined with the vertical oscillations transmitted by the above described driving mechanism. It is to be noted that one of the most important problems connected with fast knitting machines resides in the strong vibrations to which said machines are submitted when they are actuated at high speed. Obviously due to the presence of these vibrations it is impossible to increase the work speed beyond given values, which brings about a limitation in the productivity of these machines. In addition, due to said vibrations the different parts of the machine are submitted to high mechanical stresses and it is therefore necessary to provide the machine with heavy beds and frameworks in order to ensure a sufficient steadiness to the same.

Most of the above vibrations have been found to be caused by the reciprocating horizontal movement of the needle-bar and the reciprocating vertical movement of the tube-bars. In fact, each of said bars as well as the different elements connected thereto, form an important mass which is submitted to high decelerations and accelerations each time, a reversal of movement occurs. As a result of said accelerations and decelerations there are high forces of inertia which are directly transmitted to the machine framework.

SUMMARY OF THE INVENTION

In the light of the above discussed drawbacks, the main object of the present invention is substantially to solve the problems of the known art by providing a driving mechanism set up in such a manner that it eliminates all vibrations caused by the horizontal osciallatory movement of the needle-bar and vertical oscillatory movement of the tube-bars.

The foregoing and further objects which will become more apparent from the following description are substantially attained by a driving mechanism for the control of the needle-bar and tube-bars in fast knitting machines, comprising: at least a pair of auxiliary swinging arms each pivoted to one of said posts; at least a pair of first counterweights each integral to one of said auxiliary swinging arms; at least a pair of first auxiliary connecting rods each of them exhibiting one end pivoted to one of said auxiliary swinging arms and the opposite end operatively engaged with one auxiliary eccentric mounted on the first drive shaft; at least a pair of second counterweights each associated with one of the posts and slidably guided in a substantially vertical direction; at least a pair of second auxiliary connecting rods, each of them exhibiting one end pivoted to one of the second counterweights and the opposite end operatively engaged with a second auxiliary eccentric carried by the corresponding second drive shaft; said first and second auxiliary eccentrics being mounted in phase opposition relative to said first and second eccentrics in order to cause said first and second counterweights to oscillate in phase opposition relative to the oscillations performed by the needle-bar and tube-bars.

BRIEF DESCRIPTION OF THE DRAWING

Further features and advantages of the invention will best be understood from the detailed description of a preferred embodiment of the driving mechanism for the control of the needle-bar and tube-bars in fast knitting machines given hereinafter by way of non-limiting example with reference to the accompanying drawing in which the only FIGURE is a perspective fragmentary view of one half of the driving mechanism in question mounted on a fast knitting machine, the other half being substantially identical to and arranged in a mirror image of the first one.

DESCRIPTION OF THE PREFERRED EMBODIMENT

Referring to said drawing, a mechanism for the control of the needle-bar and tube-bars in fast knitting machines according to the invention has been generally identified by reference numeral 1.

The driving mechanism 1 is mounted to a pair of posts 2, only one of which is shown in the FIGURE, forming part of a support bed conventionally provided in the knitting machine with which said driving mechanism is associated. In greater detail, the driving mechanism is formed of two half parts each mounted on one of said posts 2. For the sake of clarity, during the following description reference will be made, except in case of need, to the half part of the driving mechanism associated with the post 2 herein shown, the other half part being substantially identical to and arranged in a mirror image of the first one.

In known manner, the driving mechanism 1, as shown by arrow 3*a*, is designed to impart a substantially horizontal oscillatory movement to a needle-bar 3 extending between the posts 2 of the bed and supporting a number of needles 4 suitably distributed over the same. The driving mechanism 1 is also designed to transmit a vertical oscillatory movement, as shown by arrow 5*a*, to one or several tube-bars 5 the opposite end of which are slidably engaged through oscillating supports 6 (only one of which is shown), each of them being slidably, engaged to a pair of guide rods 7 upstanding from the corresponding post 2.

Still in known manner, the tube-bars 5 are also actuated, by means of a second driving mechanism not shown as not important to the ends of the invention, with an oscillatory horizontal movement in a longitudinal direction, as shown by arrow 5*b*.

Also shown in the accompanying figure, by way of example only, is a guide bar 8 supporting a number of eye-pointed needles 9 and provided with an oscillatory movement consisting of angular oscillations as shown by arrow 8*a* and horizontal oscillations as shown by arrow 8*b*. The driving mechanism for the control of said guide bar 8 is not shown and will not be described as it is unimportant to the ends of the present invention.

The driving mechanism 1 comprises at least one drive shaft 10 rotatably engaged through each post 2. In greater detail, provision is preferably made for a pair of first drive shafts 10 each associated with one of the posts 2 and driven in rotation by a single main shaft 11 extending between said posts and rotatably supported by the posts themselves close to the base thereof.

In greater detail, the main shaft 11, or driven in rotation by a "V" belt 12 connecting it to a motor not shown, transmits a rotatory movement to each of the first drive shafts 10 by means of a toothed belt 13 operatively engaging with respective toothed pulleys 10*a*, 11*a*, carried by the first drive shaft and the main shaft itself.

In addition, at least one of the first drive shafts 10 is associated with a flywheel 14. The driving mechanism 1 also comprises a pair of first driving connecting rods 15 each of them exhibiting one end 15*a* pivoted to a swinging arm 16 in turn rotatably connected to one of the posts 2 and fixedly engaging the needle-bar 3 at one end thereof. The second end 15*b* of the driving connecting rod 15 operatively engages with one eccentric 17 fixedly carried by the corresponding first drive shaft 10.

Advantageously, associated with each one of the first drive shafts 10 is one auxiliary eccentric 18 mounted in phase opposition, that is rotated through 180°, relative to the first eccentric 17 and preferably having the same eccentricity as the latter.

Operatively engaged with the first auxiliary eccentric 18 is one end 19*a* of one auxiliary connecting rod 19 the opposite end 19*b* of which is pivoted to an auxiliary swinging arm 20 rotatably engaged to the corresponding post 2. Mounted on the auxiliary arm 20 is at least one counterweight 21 preferably exhibiting a mass equal to half the mass of the needle-bar 3 and at all events sufficient to cause the assembly consisting of the counterweight 21, auxiliary arm 20, auxiliary connecting rod 19, auxiliary eccentric 18 to have a mass substantially identical to the sum of the masses of half needle-bar 3, swinging arm 16, first driving connecting rod 15 and first eccentric 17.

The driving mechanism 1 further comprises a pair of second drive shafts 22 each of which is rotatably supported relative to the corresponding post 2. In greater detail, preferably each second drive shaft 22 is rotatably engaged through a support bracket 23 fastened to the post 2.

The second drive shaft 22 is provided with a toothed pulley 22*a* operatively engaging with said toothed belt 19 so as to cause the rotation of the shaft itself. The second drive shaft 22 integrally carries a second eccentric 24 as well, which is operatively engaged in one end 25*a* of a second driving connecting rod 25 the opposite end 25*b* of which is connected to one of the oscillating supports 6.

Moreover a second auxiliary eccentric 26 is integrally engaged to each of the second drive shafts 22, which auxiliary eccentric is mounted in phase opposition relative to the second eccentric 24 and preferably has the same eccentricity as the latter. Engaged with the second auxiliary eccentric 26 is one end 27*a* of a second auxiliary connecting rod 27 the opposite end 27*b* of which is connected to a second counterweight 28 slidably guided in a substantially vertical direction. In greater detail, the second counterweight 28 is slidably engaged on an auxiliary slide 29 fixedly carried by the support bracket 23. Preferably, the second counterweight 28 has a mass which is substantially equal to half the mass of the tube-bars 5 or at all events sufficient to cause the assembly consisting of the counterweight 28, auxiliary connecting rod 27, auxiliary eccentric 26 to have an overall mass substantially identical to the sum of the masses of half the tube-bars 5, one of the oscillating supports 6, one of the second driving connecting rods 25 and one of the second eccentrics 24.

Operation of the driving mechanism according to the invention described above mainly as regards structure, is as follows.

As previously said, the rotatory movement imparted to the main shaft 11 is transmitted, through each of the toothed belts 13, to the first and second drive shafts 10, 22. The rotation of the first drive shaft 10 causes, through the first eccentric 17, the movement of the connecting rod 15 which, as a result, makes the arm 16 oscillate about its own pivot axis. Upon oscillation of arm 16, a substantially horizontal reciprocating movement of the needle-bar 3 according to arrow 3*a* occurs.

Simultaneously, the rotation of the first shaft 10 brings about, through the first auxiliary eccentric 18, the operation of the first auxiliary connecting rod 19 the oscillatory movement of which also causes the auxiliary arm 20 to oscillate about its own pivot axis. As a result, the first counterweight is submitted to an oscillatory movement, as shown by arrow 21*a*, about the pivot axis of the auxiliary arm 20. Since the first auxiliary eccentric 18 is 180° offset with respect to the first eccentric 17, the first counterweight 21 is subjected to oscillate in phase opposition relative to the needle bar 3. Consequently, the counterweight 21 and needle-bar 3 will transmit forces of inertia to the post 2, and therefore to the knitting machine as a whole, which substantially have the same intensity but opposite senses, so that they mutually become null.

The rotation of the second drive shaft 22, in turn, causes the operation of the second driving connecting rod 25 so that it transmits a substantially vertical reciprocating movement, as shown by arrow 5*a*, to the corresponding oscillating support 6 and therefore to the tube bars 5. At the same time the second auxiliary eccentric 27*a* actuates the second auxiliary connecting rod 27 the oscillatory movement of which causes the second counterweight 28 to move in a substantially vertical direction as shown by arrow 28*a*.

Since the second auxiliary eccentric 26 is 180° offset with respect to the second eccentric 24, the oscillations of the second counterweight 28 will be in phase opposition relative to those of the tube bars 5. As a result, the forces of inertia transmitted to the machine structure by the second counterweight 28 and tube-bars 5 will be subjected to become mutually null.

The present invention attains the intended purposes. In fact, in the driving mechanism described the forces of inertia produced by the needle-bar and tube-bars are made null by the counterweights actuated by the same shafts which are designed to move the bars themselves. In this way all vibrations which in the known art are transmitted to the machine structure by effect of the above specified forces of inertia are eliminated. Obviously by eliminating these vibrations important advantages are achieved, first of all a higher speed in the operation of the knitting machine and therefore a greater productivity.

In addition, by eliminating said vibrations the stresses currently produced on the different mechanical parts of the machine are greatly reduced, which results in a greater liability. A further advantage resides in the possibility of greatly reducing the mass of the machine bed.

It will be also recognized that the original solution of adopting two first drive shafts rotated by a main shaft allows the sizes, and consequently the mass, of the eccentrics actuating the needle-bar to be remarkably reduced. In fact in known solutions these eccentrics were directly mounted on the main shaft which necessarily had a big diameter and therefore said eccentrics needed to be oversized.

Obviously many modifications and variations can be made to the invention as conceived, all of them falling within the scope of the inventive idea characterizing it.

I claim:

1. A driving mechanism for the control of the needle-bar and tube-bars in fast knitting machines, comprising:

a support bed provided with at least two side posts;

at least one drive shaft rotatably engaged through each of said posts;

a pair of swinging arms each rotatably connected to a first of said posts and fixedly engaging a needle-bar;

a pair of first driving connecting rods each of them exhibiting one end pivoted to one of said swinging arms and the opposite end operatively engaged to one eccentric carried by said first drive shaft;

at least a second drive shaft rotatably supported with respect to said posts;

a pair of oscillating supports each of them being slidably engaged in a substantially vertical direction with one of said posts and engaging at least a tube-bar at one end thereof;

a pair of second driving connecting rods each exhibiting one end connected to one of said oscillating supports and the opposite end operatively engaged with a second eccentric carried by the second drive shaft; said first and second drive shafts being driven simultaneously in rotation in order to respectively cause the operation of the needle-bar according to a substantially horizontal oscillatory movement and the operation of the tube-bar according to a substantially vertical oscillatory movement, further comprising:

at least a pair of auxiliary swinging arms each pivoted to one of said posts;

at least a pair of first counterweights each integral to one of said auxiliary swinging arms;

at least a pair of first auxiliary connecting rods each of them having one end pivoted to one of said auxiliary swinging arms and the opposite end operatively engaged with one auxiliary eccentric mounted on the first drive shaft;

at least a pair of second counterweights each associated with one of the posts and slidably guided in a substantially vertical direction;

at least a pair, of second auxiliary connecting rods, each of them having one end pivoted to one of the second counterweights and the opposite end operatively engaged with a second auxiliary eccentric carried by the corresponding second drive shaft; said first and second auxiliary eccentrics being mounted in phase opposition relative to said first and second eccentrics in order to cause said first and second counterweights to oscillate in phase opposition relative to the oscillations performed by the needle-bar and tube-bars.

2. A driving mechanism according to claim 1, wherein associated with each of said posts is a respective first drive shaft and a respective second drive shaft operatively connected to a main shaft driven in rotation and rotatably passing through the posts close to a base thereof.

3. A driving mechanism according to claim 2, wherein at each post the main shaft is operatively connected to the first drive shaft and the second drive shaft by at least a toothed belt.

4. A driving mechanism according to claim 1, wherein associated with each of said posts is said second drive shaft rotatably mounted on a support bracket fixedly connected to said post.

5. A driving mechanism according to claim 1, wherein each second counterweight is slidably engaged along an auxiliary slide and fastened to a support bracket integral with the corresponding post.

6. A driving mechanism according to claim 1, wherein the mass of each one of said first counterweights is substantially equal to half the mass of the needle-bar.

7. A driving mechanism according to claim 1, wherein the mass of each one of said second counterweights is substantially equal to half the mass of the tube-bars.

* * * * *